US006491294B1

(12) United States Patent
Hyatt

(10) Patent No.: US 6,491,294 B1
(45) Date of Patent: Dec. 10, 2002

(54) PERPENDICULAR BAR CLAMP

(76) Inventor: Dan A. Hyatt, 8340 NW. 113th Ter., Oklahoma City, OK (US) 73162

( * ) Notice: Subject to any disclaimer, the term of this patent is extended or adjusted under 35 U.S.C. 154(b) by 0 days.

(21) Appl. No.: 10/037,778

(22) Filed: Jan. 7, 2002

(51) Int. Cl.[7] ..... B25B 1/20

(52) U.S. Cl. ..... 269/41; 269/76; 269/71; 269/155; 269/249

(58) Field of Search ..... 269/41, 143, 166, 269/249, 147, 88, 152–156, 45, 100, 76, 71; 248/231.7, 229, 401, 316.1

(56) References Cited

U.S. PATENT DOCUMENTS

| | | | | |
|---|---|---|---|---|
| 242,959 A | | 6/1881 | Naglee | |
| 1,546,583 A | | 7/1925 | Hunter | |
| 2,606,583 A | | 8/1952 | O'Connor | |
| 4,141,542 A | | 2/1979 | Wolff | |
| 4,165,869 A | | 8/1979 | Williams | |
| 4,281,826 A | | 8/1981 | Calvert | |
| D279,646 S | | 7/1985 | Ferdinand | |
| 4,592,541 A | | 6/1986 | Huray | |
| 4,607,829 A | * | 8/1986 | Suska | 269/71 |
| 4,836,517 A | * | 6/1989 | Vossler | 269/41 |
| 4,957,257 A | | 9/1990 | Gonzalez | |
| 5,058,870 A | | 10/1991 | Centar | |
| 5,192,060 A | | 3/1993 | Novak | |
| 5,697,601 A | | 12/1997 | Gurule | |
| D425,771 S | | 5/2000 | Dearing | |
| 6,109,601 A | * | 8/2000 | St. John, Sr. | 269/71 |
| 6,220,589 B1 | | 4/2001 | Smith, III | |

OTHER PUBLICATIONS http://store.yahoo.com/toolsplus/bsykbml.html Bessey Clamps; Dec. 5, 2000.

http://www.woodsmith.com/main/ws128_clamps_long-.html Woodworking Clamps Woodsmith magazine 128 Dec. 5, 2000.

* cited by examiner

*Primary Examiner*—Lee Wilson
(74) *Attorney, Agent, or Firm*—Randal D. Homburg

(57) ABSTRACT

The invention is a clamping device attaching to a bar clamp or pipe clamp which, instead of providing a flat surface for singular longitudinal compression, the device allows for angular clamping, the device having a rotating base and clamping portion allowing for perpendicular or angular force application in two angular vector directions.

2 Claims, 3 Drawing Sheets

PERPENDICULAR BAR CLAMP

CROSS REFERENCE TO RELATED APPLICATIONS

None

I. BACKGROUND OF THE INVENTION

1. Field of Invention

The invention is a clamping device attaching to a bar clamp or pipe clamp which, instead of providing a flat surface for singular longitudinal compression, the device allows for angular clamping, the device having a rotating base and clamping portion allowing for perpendicular or angular force application in two angular vector directions.

2. Description of Prior Art

The following United States patents were discovered and are disclosed within this application for utility patent. All relate to different varieties of clamps. In a general search, several products are indicated upon which this device is to be applied and used, some of these products revealed in the web searches, indicating general descriptions of the type of clamps to which the invention is applied, namely the Bessey Clamps®, found in the cited material at http://store.yahoo.com/toolsplus/bskybml.html and http://www.woodsmith.com.main/ws128 clamps long.html. However, the device may be used on any bar clamp or pipe clamp.

Bi-directional clamps allowing for compression in two perpendicular planes are disclosed in U.S. Pat. No. 242,959 to Naglee, U.S. Pat. No. 4,957,257 to Gonzalez, U.S. Pat. No. 5,697,601 to Gurule and U.S. Pat. No. 6,220,589 to Smith III. These clamps indicate a clamping of inserted material in two perpendicular planes, but lack the ability to draw one piece into another for a T-joint. They also lack the ability to rotate the clamping directions to an adjusted acute angle of less than 90 degrees. U.S. Pat. No. 4,592,541 to Huray discloses a composition clamp having multiple clamping features, including a pipe holding attachment. Attachments for pipe clamps to assist in the reduction of bowing of the clamped object in a flat plane are disclosed in U.S. Pat. No. 5,192,060 to Novak and U.S. Pat. No. 5,058,870 to Cetnar.

Multiple component clamps are disclosed in U.S. Pat. No. 2,606,583 to O'Connor and U.S. Pat. No. 4,141,542 to Wolff, combined to allow for perpendicular plane joining and clamping. T-clamps are shown in U.S. Pat. No. 4,281,826, to Calvert and U.S. Pat. No. 4,165,869 to Williams used for style and rail clamps and also for right angle glueing of multiple pieces. A perpendicular board clamp is disclosed in U.S. Design Pat. No. D 425,771 to Dearing. In U.S. Pat. No. D 279,646 to Ferdinand, the type of pipe clamp to which the current invention is applied is disclosed, the invention inserted onto the pipe in place of the sliding piece shown in FIG. 3, and the left sides of FIGS. 1 and 4–6, suing the pipe clamp embodiment of the invention.

II. SUMMARY OF THE INVENTION

The primary objective of the invention is to provide a adapted end for a pipe clamp or bar clamp allowing for angular clamping, primarily in dadojoints or other clamping situations where two directions of force are required. Especially in a situation where a T-joint clamp is required, none of the other inventions previously cited, allow for the holding of one piece of the joint material to be grasped while clamping that grasped piece to another piece at an angle from 90 degrees to a very acute angle.

A second objective of the invention is to provide this device adapted to fit on conventional pipe clamps and bar clamps as an accessory in addition to the already available pipe clamps and bar clamps in lieu of requiring the purchase of an entire clamp, reducing the cost to a consumer craftsman.

III. DESCRIPTION OF THE DRAWINGS

The following drawings are submitted with this utility patent application.

IV. DESCRIPTION OF THE PREFERRED EMBODIMENT

Figure 1:
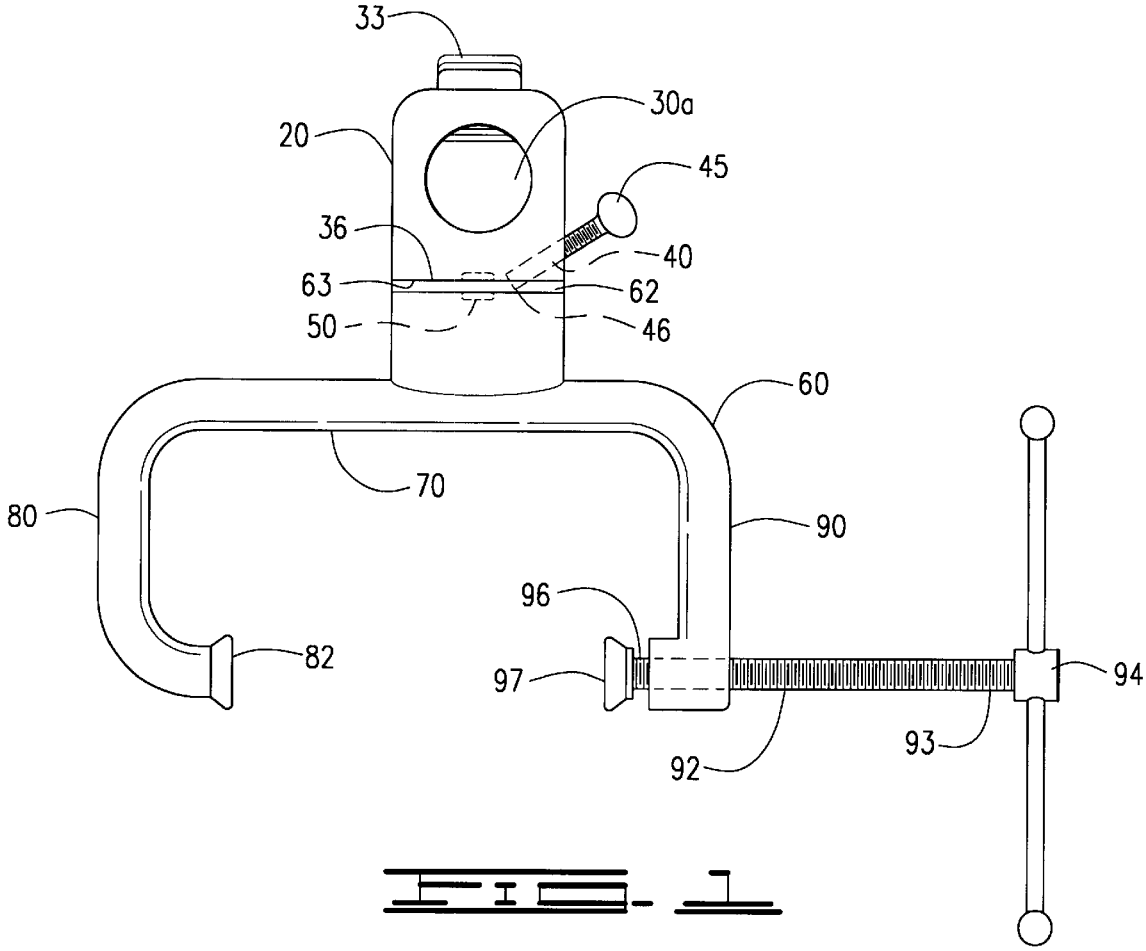
FIG. 1 is a front view of a first embodiment of the invention.
Figure 2:
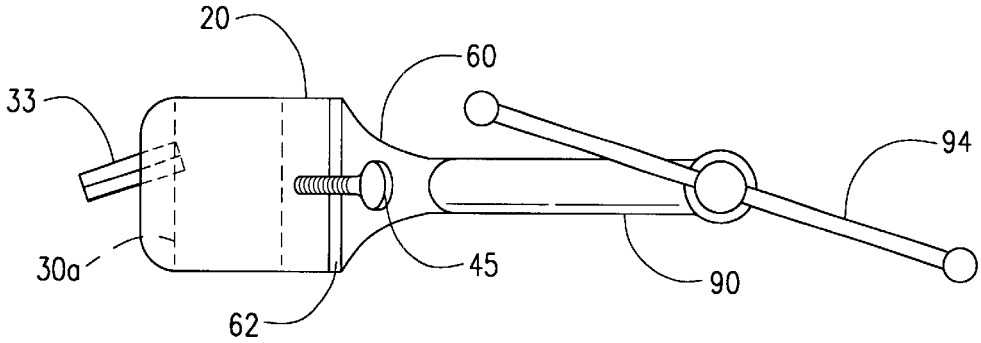
FIG. 2 is a side view of a first embodiment of the invention.

The invention is an accessory device for use on a pipe clamp 100, the device, as shown in FIGS. 1–4, applied as a substitute for a sliding member on the pipe clamp, allowing for the angular compression and joining of two pieces of material from an acute angle to a right angle, the device comprising a sliding base member 20 slidably engaging a pipe 102 of a pipe clamp 100, the sliding base member 20 joined to a rotating clamp member 60 by a central rivet 50, the relative position of the sliding base member 20 and the rotating clamp member 60 secured by a threaded set screw 45, the sliding base member 20 and the rotating clamp member 60 capable of rotation in a 360 degree plane.

In a first embodiment of the device, the sliding base member 20 further includes a central circular through bore 30*a*, a plurality of binding engagement plates 33 encroaching within the central circular through bore 30*a*, a rotating engagement surface 36 and an angular threaded set screw channel 40 encroaching onto the rotating engagement surface 36 with the threaded set screw 45 having an end 46, the threaded set screw 45 threadably engaging the threaded set screw channel 40.

The rotating clamp member 60 includes a rotating engagement plate 62 having a flat upper surface 63, a central bar portion 70, from which depends a first arm 80 having a stationary bearing plate 82 and a second arm 90 threadably containing a threaded tightening screw member 92 with a first end 93 including a tightening handle 94 and a second end 96 including a pivotal bearing plate 97. The rotating engagement plate 62 and the rotating engagement surface 36 rotate upon each other, held together by the central rivet 50, the end 46 of the threaded set screw 45 engaging the upper surface 63 of the rotating engagement plate 62 to hold the sliding base member 20 in a fixed position with the rotating clamp member 60.

Figure 3:
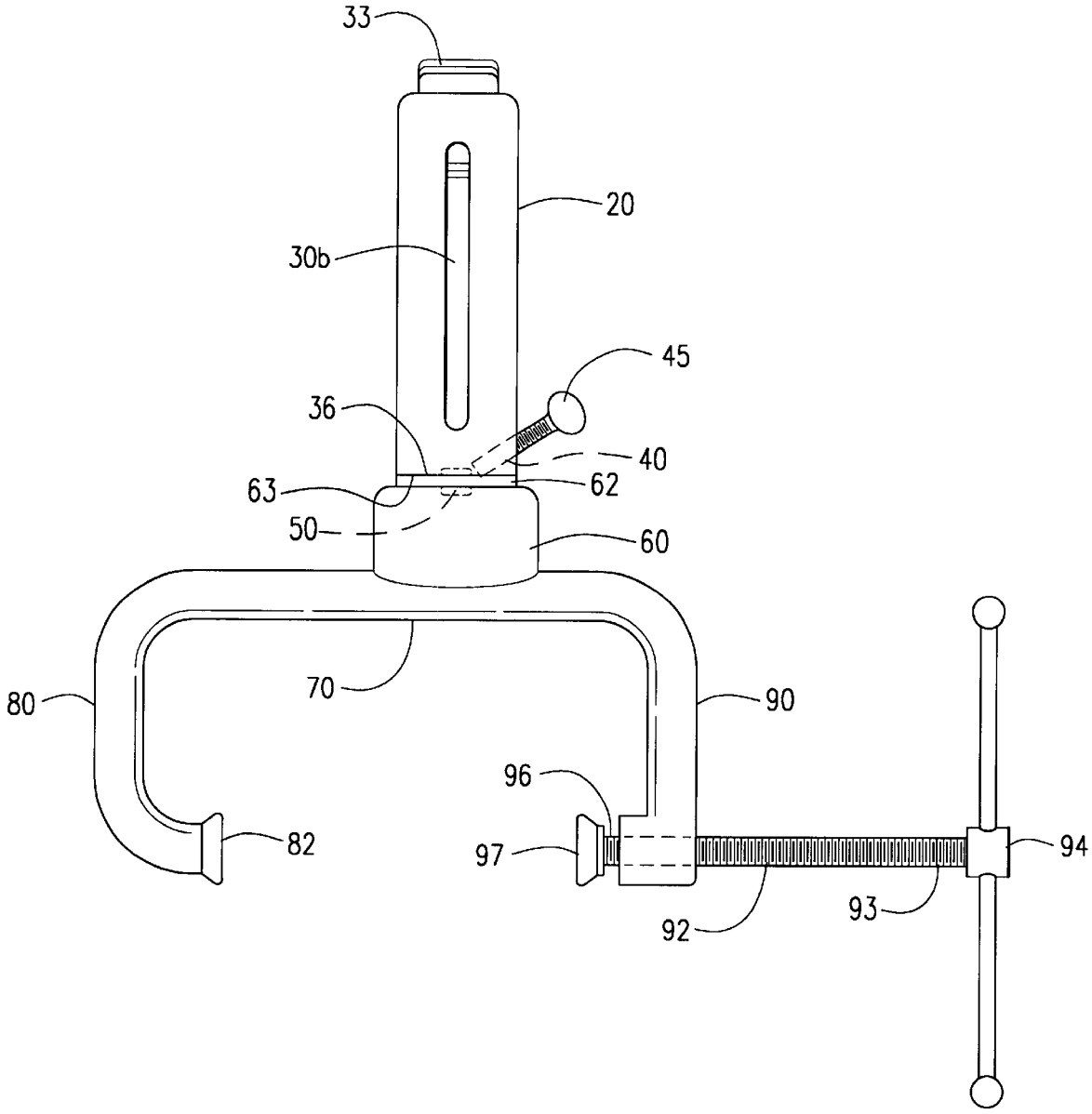
FIG. 3 is a front view of a second embodiment of the invention.
Figure 4:
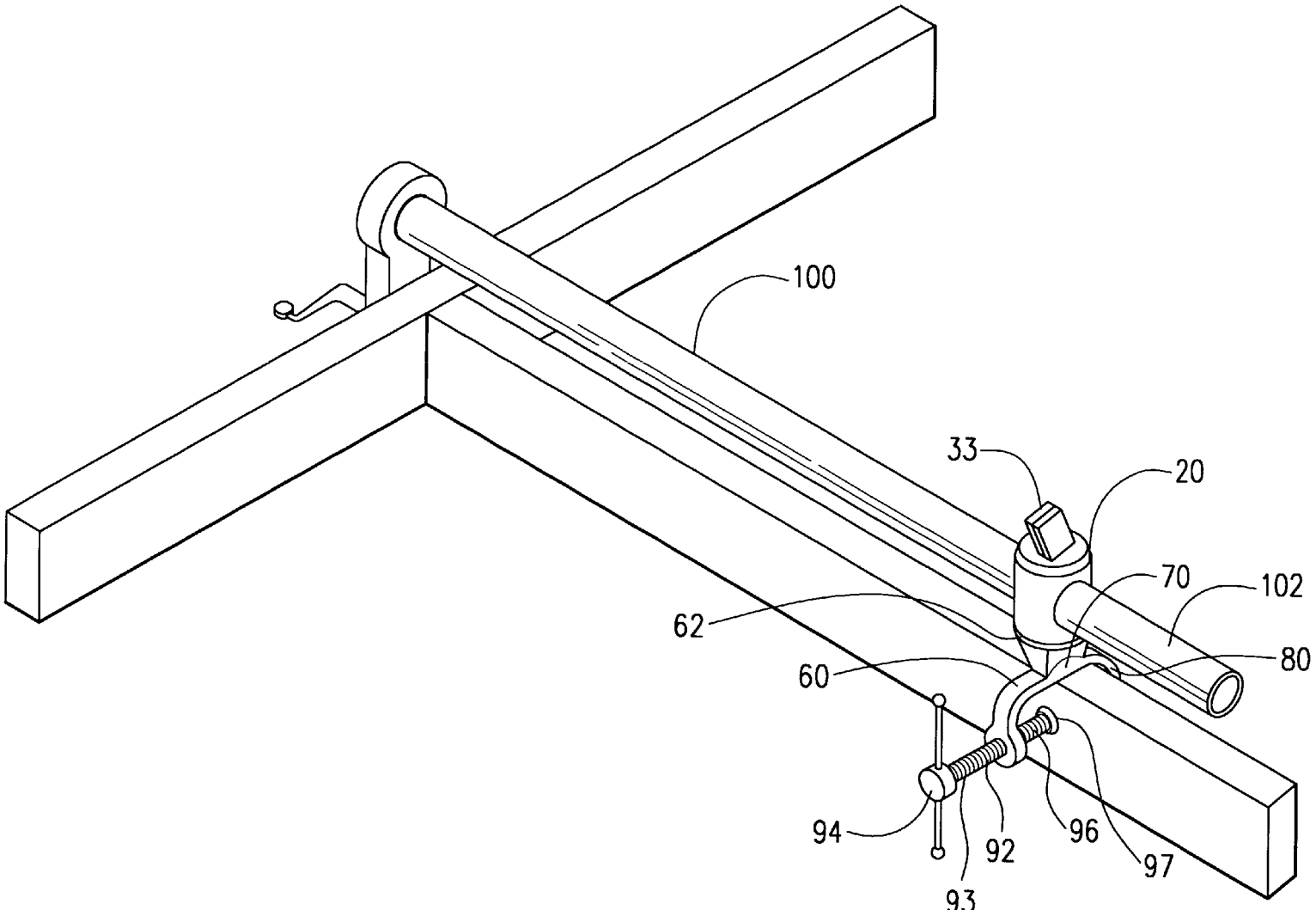
FIG. 4 is a perspective view of the invention, shown in use on a pipe clamp joining two pieces of material.

A second embodiment of the invention, as shown in FIG. 3 of the drawings, is virtually the same as the first embodiment, with the exception of the sliding base member 20 including a central linear through bore 30*b*, with the plurality of binding engagement plates 33 encroaching within such central linear through bore 30*b*, the second embodiment being suited for placement on a bar of a bar clamp instead of fitting the pipe of the pipe clamp.

The device is used to attach two pieces of material together at an angle, from ninety degrees to a slight acute angle. Intended use of the device would include the placement of the device on the pipe 102 of a pipe clamp 100 by inserting the pipe 102 through the central circular through bore 30*a*, locking the binding engagement plates 33 onto the pipe 102 at a desired position, attaching a piece of material between the stationary bearing plate 82 and the pivotal bearing plate 97, tightening the threaded tightening screw member 92 to firmly grasp the piece of material, setting the desired relative angle between the rotating engagement plate 62 and the rotating engagement surface 36, and clamping the piece of material to another piece of material within the pipe clamp 100.

The rotating engagement plate 62 and the rotating engagement surface 36 may also include markings, not shown, which indicate the relative angle, thus allowing for the setting of the rotating engagement plate 62 and the rotating engagement surface 36 at a designated and specified relative angle.

While the invention has been particularly shown and described with reference to a preferred embodiment thereof, it will be understood by those skilled in the art that changes in form and detail may be made therein without departing from the spirit and scope of the invention.

What is claimed is:

1. An accessory device for use on a pipe clamp, substituting for a sliding member on a pipe on the pipe clamp, allowing for a angular compression and joining of two pieces of material from an acute angle to a right angle, the device comprising:

a sliding base member slidably engaging a pipe of a pipe clamp, the sliding base member joined to a rotating clamp member by a central rivet, a relative position of the sliding base member and the rotating clamp member secured by a threaded set screw, the sliding base member and the rotating clamp member capable of rotation in a 360 degree plane;

the sliding base member further including a central circular through bore, a plurality of binding engagement plates encroaching within the central circular through bore, a rotating engagement surface and an angular threaded set screw channel encroaching onto the rotating engagement surface with the threaded set screw having an end, the threaded set screw threadably engaging the threaded set screw channel; and the rotating clamp member further including a rotating engagement plate having a flat upper surface, a central bar portion, from which depends a first arm having a stationary bearing plate and a second arm threadably containing a threaded tightening screw member with a first end including a tightening handle and a second end including a pivotal bearing plate, wherein the rotating engagement plate and the rotating engagement surface rotate upon each other, held together by the central rivet, the end of the threaded set screw engaging the upper surface of the rotating engagement plate to hold the sliding base member in fixed position with the rotating clamp member.

2. An accessory device for use on a bar clamp, substituting for a sliding member on a baron the bar clamp, allowing for a angular compression and joining of two pieces of material from an acute angle to a right angle, the device comprising:

sliding base member slidably engaging the bar of the bar clamp, the sliding base member joined to a rotating clamp member by a central rivet, a relative position of the sliding base member and the rotating clamp member secured by a threaded set screw, the sliding base member and the rotating clamp member capable of rotation in a 360 degree plane;

the sliding base member further including a central linear trough bore, a plurality of binding engagement plates encroaching within the central linear through bore, a rotating engagement surface and an angular threaded set screw channel encroaching onto the rotating engagement surface with the threaded set screw having an end, the threaded set screw threadably engaging the threaded set screw channel; and the rotating clamp member further including a rotating engagement plate having a flat upper surface, a central bar portion, a first arm having a stationary bearing plate and a second arm threadably containing a threaded tightening screw member with a first end including a tightening handle and a second end including a pivotal bearing plate, wherein the rotating engagement plate and the rotating engagement surface rotate upon each other, held together by the central rivet, the end of the threaded set screw engaging the upper surface of the rotating engagement plate to hold the sliding base member in a fixed position with the rotating clamp member.

* * * * *